US006033274A

United States Patent [19]

Mizuguchi et al.

[11] Patent Number: 6,033,274

[45] Date of Patent: Mar. 7, 2000

[54] EXHAUST ARRANGEMENT FOR AN OUTBOARD MARINE DRIVE ENGINE

[75] Inventors: Hiroshi Mizuguchi; Mitsuharu Tanaka, both of Wako, Japan

[73] Assignee: Honda Giken Kogyo Kabushiki Kaisha, Tokyo, Japan

[21] Appl. No.: 09/152,745

[22] Filed: Sep. 14, 1998

[30] Foreign Application Priority Data

Sep. 12, 1997 [JP] Japan ..... 9-248945

[51] Int. Cl.[7] ..... B63H 21/32

[52] U.S. Cl. ..... 440/89; 440/900

[58] Field of Search ..... 181/235; 440/88, 440/89, 53, 52, 900; 123/195 P

[56] References Cited

U.S. PATENT DOCUMENTS 4,887,692 12/1989 Outani et al. ..... 440/89

FOREIGN PATENT DOCUMENTS 2506245 8/1975 Germany ..... 440/89

2-13703 4/1990 Japan .

*Primary Examiner*—Ed Swinehart

*Attorney, Agent, or Firm*—Skjerven, Morrill, MacPherson, Franklin & Friel LLP; Alan H. MacPherson; Hugh H. Matsubayashi

[57] ABSTRACT

In an outboard marine drive, a primary partition made of elastomeric material is provided in a lower part of the extension case, and a drive shaft and an exhaust pipe are sealingly passed through the primary partition. Thereby, the extension case is kept out of direct contact from the exhaust gas, and is therefore prevented from excessive heating. The exhaust pipe and the drive shaft typically have a large length, and it is advantageous to support them at parts thereof near a lower end thereof. The use of elastomeric material for the primary partition is particularly advantageous because it not only can favorably insulate heat but also can accommodate any positional errors in the exhaust pipe and the drive shaft relative to the extension case. When a secondary opening is formed in an upper part of the exhaust pipe to prevent excessive build up of exhaust back pressure when the engine is idling, a secondary partition may also be provided in an upper part of the extension case.

7 Claims, 4 Drawing Sheets

EXHAUST ARRANGEMENT FOR AN OUTBOARD MARINE DRIVE ENGINE

TECHNICAL FIELD

The present invention relates to an exhaust arrangement for an outboard marine drive incorporated with an air-cooled internal combustion engine.

BACKGROUND OF THE INVENTION

It is advantageous to use an air-cooled internal combustion engine for a small outboard marine drive in view of reducing weight. The exhaust gas expelled from the engine is high in temperature, and it is therefore essential to prevent the heat from the exhaust gas from heating various parts of the outboard marine drive. According to the invention disclosed in Japanese UM publication (kokoku) No. 2-13703, a small water pump is provided in a lower end of a vertical drive shaft to feed water to an upper part of an extension case adjacent to an exhaust port. This however complicates the structure, and hence increases the manufacturing cost. Furthermore, the pump causes a corresponding loss in the output of the engine.

BRIEF SUMMARY OF THE INVENTION

In view of such problems of the prior art, a primary object of the present invention is to provide an outboard marine drive using an air-cooled internal combustion engine which is made free from the ill effects of hot exhaust gas without complicating the structure or increasing the manufacturing cost.

A second object of the present invention is to provide an outboard marine drive using an air-cooled internal combustion engine which can effectively prevent exhaust gas from flowing back into the engine room.

A third object of the present invention is to provide an outboard marine drive using an air-cooled internal combustion engine which can avoid water from flowing back into the exhaust pipe even in case of engine misfire.

According to the present invention, these and other objects can be accomplished by providing an exhaust arrangement for an outboard marine drive including an internal combustion engine, an extension case extending downward from the engine and accommodating therein a drive shaft for taking out rotative power from the engine, and a gear case attached to a lower end of the extension case and accommodating a propeller shaft and a gear mechanism for transmitting rotative power from a lower end of the drive shaft to the propeller shaft, further comprising: an exhaust pipe extending vertically inside the extension case, and having an upper end connected to an exhaust port of the engine, and a lower end submerged in water inside the extension case; and a primary partition provided in a lower part of the extension case having a lower end of the exhaust pipe sealingly passed therethrough.

Thus, the extension case is favorably thermally insulated from the exhaust gas. In this regard, it is preferable to form the partition with a heat-resistant and heat-insulating material. The exhaust pipe typically has a large length, and it is advantageous to support a part of the exhaust pipe at a point near a lower end thereof. Elastomeric material is particularly advantageous because it not only increases the tolerance for the positional accuracy of the exhaust pipe relating to the extension case but also provides a favorable damping effect against vibration of the exhaust pipe. When the drive shaft is additionally passed through this partition, it is preferable to fit a bushing typically made of wear resistant metal or alloy in the hole formed in the partition to receive the drive shaft. The partition has the additional function of preventing exhaust gas from flowing back into the engine room through the interior of the extension case.

According to a preferred embodiment of the present invention, a secondary opening is provided in a part of the exhaust pipe located above water, and a secondary partition is formed in the extension case so as to separate the secondary opening of the exhaust pipe from an interior part of the extension case above the secondary opening. In this case, an idle release hole is typically provided in a part of the extension case adjacent to the secondary opening of the exhaust pipe for communication an interior part of the extension case to the atmosphere. The secondary opening prevents the build up of excessive back pressure in the exhaust pipe which could prevent a stable idling operation of the engine. The exhaust gas released from the secondary opening is prevented from flowing back into the engine room by the secondary partition which may be integrally formed with the extension case. The secondary opening has the additional function of preventing water from flowing into the exhaust pipe in case of engine misfire. An expansion chamber member may be attached to an outer surface of the extension case so as to define an expansion chamber for the idle release hole, and thereby minimize noises due to the release of exhaust gas from the idle release hole.

BRIEF DESCRIPTION OF THE DRAWINGS

Now the present invention is described in the following with reference to the appended drawings, in which.

DETAILED DESCRIPTION OF THE PREFERRED EMBODIMENTS

Figure 1:
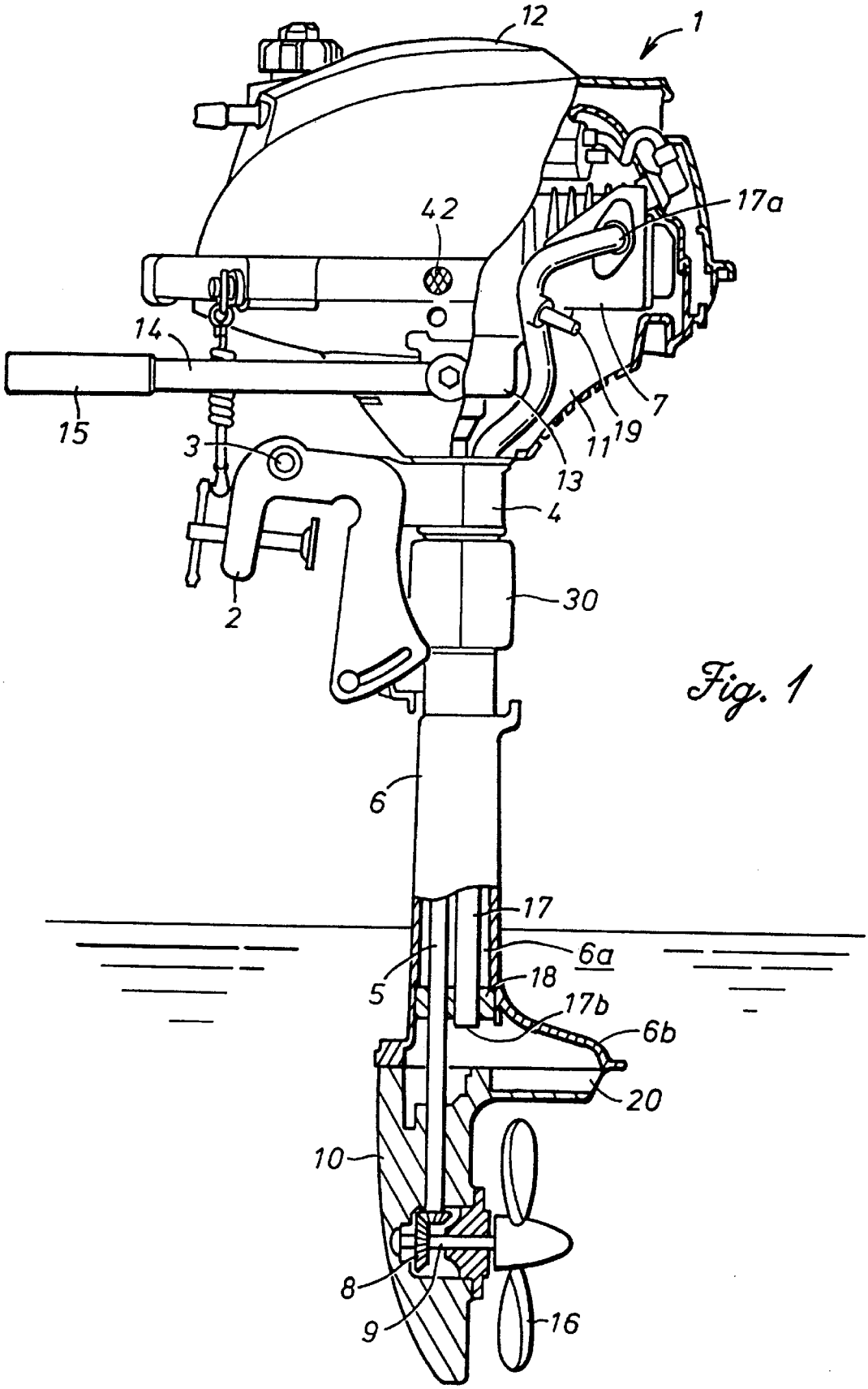
FIG. 1 is a partly broken-away side view of an outboard marine drive embodying the present invention.

FIG. 1 generally illustrates a side view of an outboard marine drive embodying the present invention. This outboard marine drive 1 is adapted to be attached to a transom of a boat (not shown in the drawing) with a stern bracket 2 having a clamping capability. To the stem bracket 2 is attached a swivel case 4 via a tilt shaft 3 extending horizontally across the width of the boat. The swivel case 4 in turn supports a tubular extension case 6 accommodating therein a vertically extending drive shaft 5. The swivel case 4 permits the main part of the outboard marine drive to rotate 360 degrees around a vertical steering axis relative to the stem bracket 2 or the boat.

The upper end of the extension case 6 is attached to an internal combustion engine 7, and the lower end of the extension case 6 is attached to a gear case 10 accommodating therein a propeller shaft 9 and a bevel gear mechanism 8 for transmitting the rotative power from the lower end of the drive shaft 5 to the propeller shaft 9.

The engine 7 consists of a vertical-crankshaft, air-cooled, single-cylinder, four-stroke internal combustion engine, and is generally covered by an under case 11 and an engine cover 12 which are detachably joined with each other. The cylinder head of this engine is directed rearward with a slight angular offset to one side. The lower end of a crankshaft 32 (FIG. 2) of this engine 7 is connected to the upper end of the drive shaft 5 via a known centrifugal clutch device 13. The under case 11 is attached to the bottom surface of a housing of the centrifugal clutch device 13 so that the engine cover 12 may be removed while the under case 11 is kept attached to the engine 7.

The housing of the centrifugal clutch device 13 is provided with an arm (not shown in the drawings) which extends out of the under case 11, and a free end of this arm is attached to a steering arm 14 which can turn in a horizontal plane. By thus angularly moving the steering arm 14, the outboard marine drive main body can be turned around a vertical axis for steering the boat. A free end of the steering arm 14 is provided with a throttle grip 15 for operating a throttle valve of a carburetor (not shown in the drawing) of the engine 7. When the rotational speed of the engine 7 is increased beyond a certain level by suitably twisting the throttle grip 15, the centrifugal clutch device 13 is engaged, and the rotational power of the crankshaft is transmitted to the propeller 16 via the drive shaft 5 and the propeller shaft 9.

An exhaust pipe 17 has an upper end 17*a* which is connected to an exhaust port of the cylinder block, and extends from the engine room into the extension case 6 along a curved path. The lower end 17*b* of the exhaust pipe 17 terminates at a point adjacent to the lower end 6*b* of the extension case 6. The exhaust pipe 17 extends substantially in parallel with the drive shaft 5 inside the extension case 6, and its lower end 17*b* is supported by a circular primary partition member 18 which is made of resilient elastomeric material and fitted into a bore defined at the lower end 6*b* of the extension case 6. An inlet opening 19 is provided in a curved part of the exhaust pipe 17 adjacent to the cylinder block for receiving a probe for analyzing the contents of the exhaust gas.

The exhaust gas from the engine 7 is released from the lower end 17*b* of the exhaust pipe 17, and is normally released into the water from an opening 20 defined in the interface between the extension case 6 and the gear case 10. The exhaust gas is then pushed rearward in the water by the water flow produced by the propeller 16. Because the interior 6*a* of the extension case 6 is separated from a lower part thereof by the primary partition member 18, the exhaust gas is prevented from flowing upward inside the extension case 6.

Figure 2:
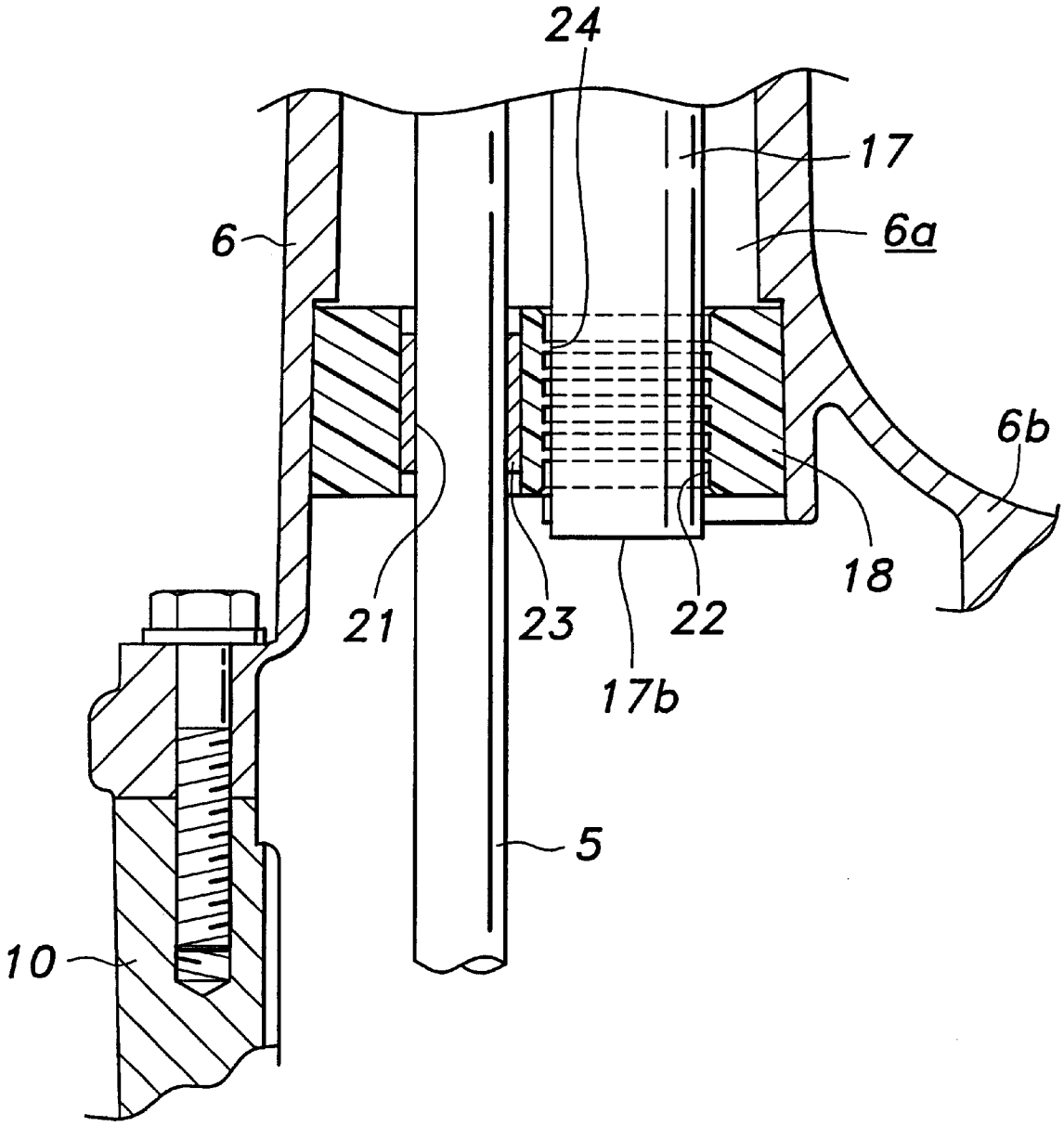
FIG. 2 is a fragmentary sectional side view of a part surrounding the primary partition member.

Referring to FIG. 2, the primary partition member 18 is provide with a drive shaft receiving hole 21 and an exhaust pipe receiving hole 22 to pass the drive shaft 5 and the exhaust pipe 17, respectively, therethrough. The drive shaft receiving hole 21 is fitted with a bushing 23 made of sintered alloy to rotatably support the drive shaft 5. The bushing 23 may be made of any wear resistant material. The exhaust pipe receiving hole 22 is provided with a plurality of annular projections 24 so as to hold the lower end of the exhaust pipe 7 with a certain resiliency and with an improved heat insulating capability. Because the primary partition member 18 is itself made of resilient elastomeric material, it can accommodate errors in relative positions of the extension case 6, the drive shaft 5 and the exhaust pipe 17 by its deformation.

Figure 3:
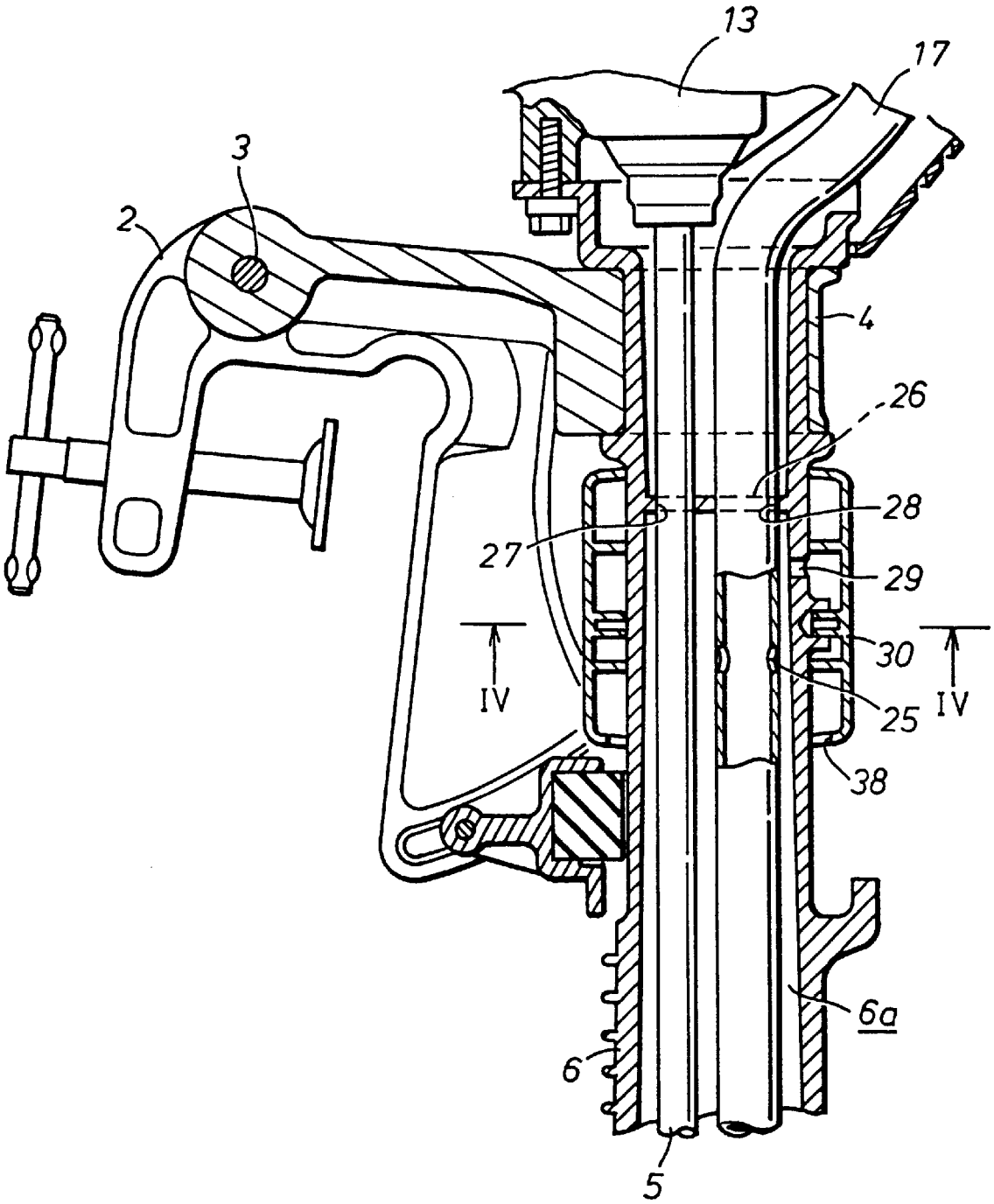
FIG. 3 is a fragmentary sectional side view of a part surrounding the secondary opening of the exhaust pipe.

Referring to FIG. 3, a part of the exhaust pipe 17 immediately below the swivel case 4 is provided with secondary openings 25 passed diagonally across the exhaust pipe 17. A secondary partition 26 is formed in a part of the interior 6*a* of the extension case 6 immediately above the secondary openings 25 integrally with the extension case 6. This secondary partition 26 is also provided with a drive shaft receiving hole 27 and an exhaust pipe receiving hole 28 to sealingly pass the drive shaft 5 and the exhaust pipe 17, respectively, therethrough. In a part of the extension case 6 vertically between the secondary partition 26 and the secondary openings 25 is formed an idle release hole 29 for communicating the interior 6*a* of the extension case 6 to the outside.

Figure 4:
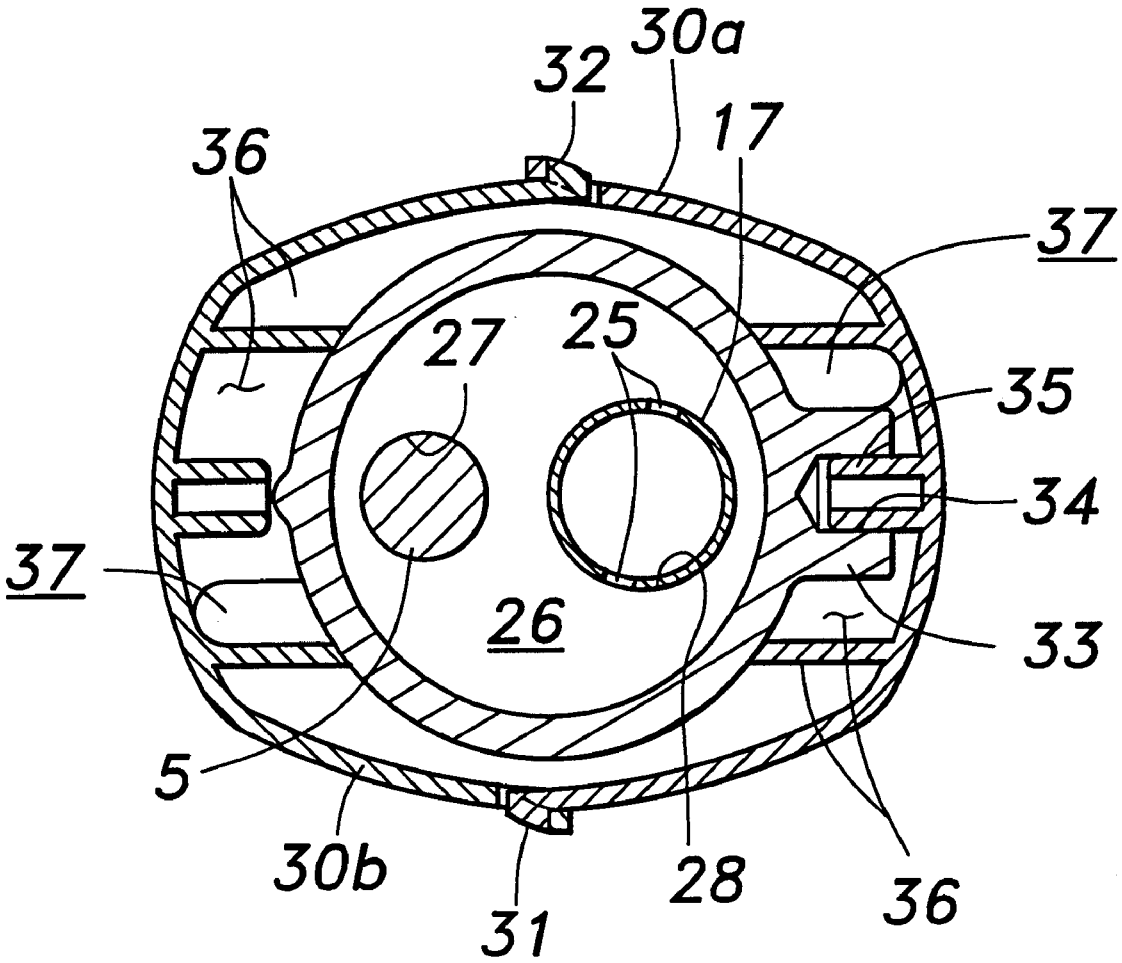
FIG. 4 is a cross sectional view taken along line IV—IV of FIG. 3.

Referring to FIGS. 3 and 4, an expansion chamber member 30 is placed around the part of the extension case 6 provided with the idle release hole 29. This expansion chamber member 30 is formed by joining two semi-cylindrical halves 30*a* and 30*b* into a full-cylindrical shape, and is held in position by engagement of tongues 31 and corresponding slots 32 provided in opposing edges thereof. Also, by fitting an inwardly directed projection 35 formed in the inner surface of one of the halves 30*a* into a recess 34 formed in a boss 33 projecting from the outer surface of the extension case 6, the expansion chamber member 30 is firmly held in position against axial and circumferential movements. The joining of the two halves 30*a* and 30*b* can also be accomplished by other arrangements such as joining the two halves with each other by using threaded bolts, and attaching both the two halves, respectively, to the extension case 6.

The expansion chamber member 30 is provided with a plurality of ribs 36 and defines a plurality of chambers separated by these ribs 36 in cooperation with the outer surface of the extension case 6. The chambers are appropriately communicated with each other via notches 37 provided in the ribs 36. The lower end of the expansion chamber member 30 defines a small gap 38 relative to the outer surface of the extension case 6.

When the engine 7 is idling and the lower end 17*b* of the exhaust pipe 17 is submerged in water, the exhaust back pressure could get too high for the engine to idle in a stable fashion. However, according to this arrangement, because the exhaust gas is expelled also from the secondary openings 25, the engine 7 can idle in a stable fashion even under such a condition. Because the exhaust gas is released to the atmosphere via the expansion chambers defined inside the expansion chamber member 30, the exhaust noise is minimized. The exhaust gas expelled from the secondary openings 25 initially enters the interior 6*a* of the. extension case 6, but because the interior 6*a* of the extension case 6 is closed by the secondary partition 26 from above, the exhaust gas from the secondary openings 25 is prevented from flowing back into the engine room. The secondary openings 25 also serve the purpose of drawing water into the exhaust pipe 17 in case of misfire by drawing air from the secondary openings 25 into the exhaust pipe 17.

Thus, according to the present invention, without requiring any special cooling arrangement, the extension case is thermally insulated from the exhaust gas. Although the present invention has been described in terms of a preferred embodiment thereof, it is obvious to a person skilled in the art that various alterations and modifications are possible without departing from the scope of the present invention which is set forth in the appended claims.

We claim:

1. An exhaust arrangement for an outboard marine drive, comprising:

an internal combustion engine;

an extension case extending downward from said engine and accommodating therein a drive shaft for taking out rotative power from said engine;

a gear case attached to a lower end of said extension case and accommodating a propeller shaft and a gear mechanism for transmitting rotative power from a lower end of said drive shaft to said propeller shaft;

an exhaust pipe extending vertically inside said extension case, and having an upper end connected to an exhaust port of said engine, and a lower end submerged in water inside said extension case; and a primary partition provided in a lower part of said extension case having the lower end of said exhaust pipe sealingly passed therethrough.

2. An exhaust arrangement for an outboard marine drive according to claim 1, wherein said primary partition includes a resilient partition member fitted into an internal bore of said extension case, and having a hole receiving said lower end of said exhaust pipe.

3. An exhaust arrangement for an outboard marine drive according to claim 2, wherein said drive shaft is additionally passed through said resilient partition member.

4. An exhaust arrangement for an outboard marine drive according to claim 3, wherein said drive shaft is passed through a hole provided in said resilient partition member fitted with a bushing made of harder material.

5. An exhaust arrangement for an outboard marine drive according to claim 1, wherein a secondary opening is provided in a part of said exhaust pipe located above water, and a secondary partition is formed in said extension case so as to separate said secondary opening of said exhaust pipe from an interior part of said extension case above said secondary opening.

6. An exhaust arrangement for an outboard marine drive according to claim 5, wherein an idle release hole is provided in a part of said extension case adjacent to said secondary opening of said exhaust pipe for communicating an interior part of said extension case to the atmosphere.

7. An exhaust arrangement for an outboard marine drive according to claim 6, further comprising an expansion chamber member attached to an outer surface of said extension case so as to define an expansion chamber for said idle release hole.

* * * * *